United States Patent [19]

Bleeker et al.

[11] 3,974,489

[45] Aug. 10, 1976

[54] CENTRALIZED MONITOR AND ALARM SYSTEM FOR MONITORING REMOTE AREAS WITH ACOUSTICAL ELECTRIC TRANSDUCERS

[76] Inventors: George H. Bleeker, 4543 N. Dover, Chicago, Ill. 60640; David G. Geis, 5927 W. Addison, Chicago, Ill. 60634

[22] Filed: Aug. 30, 1972

[21] Appl. No.: 284,743

[52] U.S. Cl. ..... 340/261; 340/258 D; 340/409

[51] Int. Cl.[2] ..... G08B 13/00

[58] Field of Search ..... 340/261, 225, 409, 410, 340/258 D, 331

[56] References Cited

UNITED STATES PATENTS

| | | | |
|---|---|---|---|
| 2,436,047 | 2/1948 | Martin | 340/261 |
| 2,709,251 | 5/1955 | Schmidt | 340/261 |
| 3,437,759 | 4/1969 | McKinzie | 340/261 |
| 3,503,062 | 3/1970 | Witzke et al. | 340/331 |
| 3,513,465 | 5/1970 | Titherington | 340/261 |
| 3,553,669 | 1/1971 | Merchant et al. | 340/261 |
| 3,705,401 | 12/1972 | Scott | 340/261 |

*Primary Examiner*—Glen R. Swann, III

*Attorney, Agent, or Firm*—Fitch, Even, Tabin & Luedeka

[57] ABSTRACT

A centralized system for simultaneously monitoring a plurality of predetermined remote areas and selectively indicating an unauthorized intrusion into any of the areas. A preamplifier is placed in each of the areas for amplifying the electrical signals from each of a set of microphones in that area and the amplified signal is coupled to a central monitoring and alarm station. The central station may provide a sound level indicating lamp for each area, an alarm lamp to indicate when the sound in each area exceeds a predetermined background or threshold level, and a system for simultaneously listening to the actual sound in all of the remote areas or selectively listening to the sound in any one of the areas.

8 Claims, 3 Drawing Figures

AUDIO AMPLIFIER WITH VOLUME CONTROL
CENTRAL UNIT
REMOTE AREAS
CONTROL CIRCUIT "A"
CONTROL CIRCUIT "B"
CONTROL CIRCUIT "C"
CONTROL CIRCUIT "D"
PREAMPLIFIER
PREAMPLIFIER
PREAMPLIFIER
PREAMPLIFIER
AREA "A"
AREA "B"
AREA "C"
AREA "D"
MICROPHONES
POWER
ALARM
LEVEL
SABOTAGE
SABO.
ON
OFF
ALL
AREA A
AREA B
AREA C
AREA D

CENTRALIZED MONITOR AND ALARM SYSTEM FOR MONITORING REMOTE AREAS WITH ACOUSTICAL ELECTRIC TRANSDUCERS

FIELD OF THE INVENTION

This invention relates generally to intruder alarm systems and more particularly to centralized systems for simultaneously monitoring a plurality of remote areas by acoustoelectric transducers and for selectively indicating an unauthorized intrusion into any of the remote areas.

BACKGROUND OF THE INVENTION

Among the conventional systems for detecting unauthorized intrusion into a given area are systems in which acoustoelectric transducers monitor several remote areas and convert sounds occurring in these areas into electrical signals which are transmitted to a centrally-located monitoring unit for review by security personnel. Such areas include, for example, entrances to large department stores, office buildings, high-rise apartment buildings, or factories. When a sound at a given remote area exceeds a predetermined threshold value, a transducer means transmits the sound to the monitoring unit having an alarm indicating means such as an audio alarm and/or visual light which is actuated to alert the security personnel.

While it is possible to provide very elaborate and sophisticated electronic intruder alarm systems for the security personnel, such systems are generally too expensive to construct for practical use in many applications. Moreover, such complicated systems are generally not operated proficiently by most security personnel because of a lack of understanding, confidence, or even ability required to operate complicated electronic apparatus. Centralized systems of this kind should therefore be relatively simple and foolproof in their operation as well as highly immune to sabotage by sophisticated criminals.

Another frequent shortcoming of many present systems is their lack of flexibility to accommodate unusual situations without triggering the alarms. For example, the presence of cleaning personnel, traffic noise, or nearby construction may result in one area having significantly higher background noise than any other area and which may trigger an alarm when there has been no unauthorized intrusion into that area. Preferably, a centralized system should permit simultaneous monitoring of all of the remote areas for individual noises and sound levels. This facilitates distinguishing rather quickly between an unauthorized intrusion into an area, which requires immediate and cautious attention, and a noise which upon closer listening can be identified as not resulting from an intrusion into the area by a burglar or other unauthorized persons.

As space is costly in many of these locations, the systems should be small and compact and readily installed with simple cables. Also, detection of sabotage should be provided as should tests for checking the operation of the system.

Accordingly, an object of the present invention is to provide an improved centralized system of the foregoing kind for monitoring a plurality of remote areas.

DESCRIPTION OF THE DRAWINGS

Other objects and advantages of the invention are more particularly set forth in the following detailed description and in the accompanying drawings of which.

DESCRIPTION OF PREFERRED EMBODIMENT

Figures 1, 2:
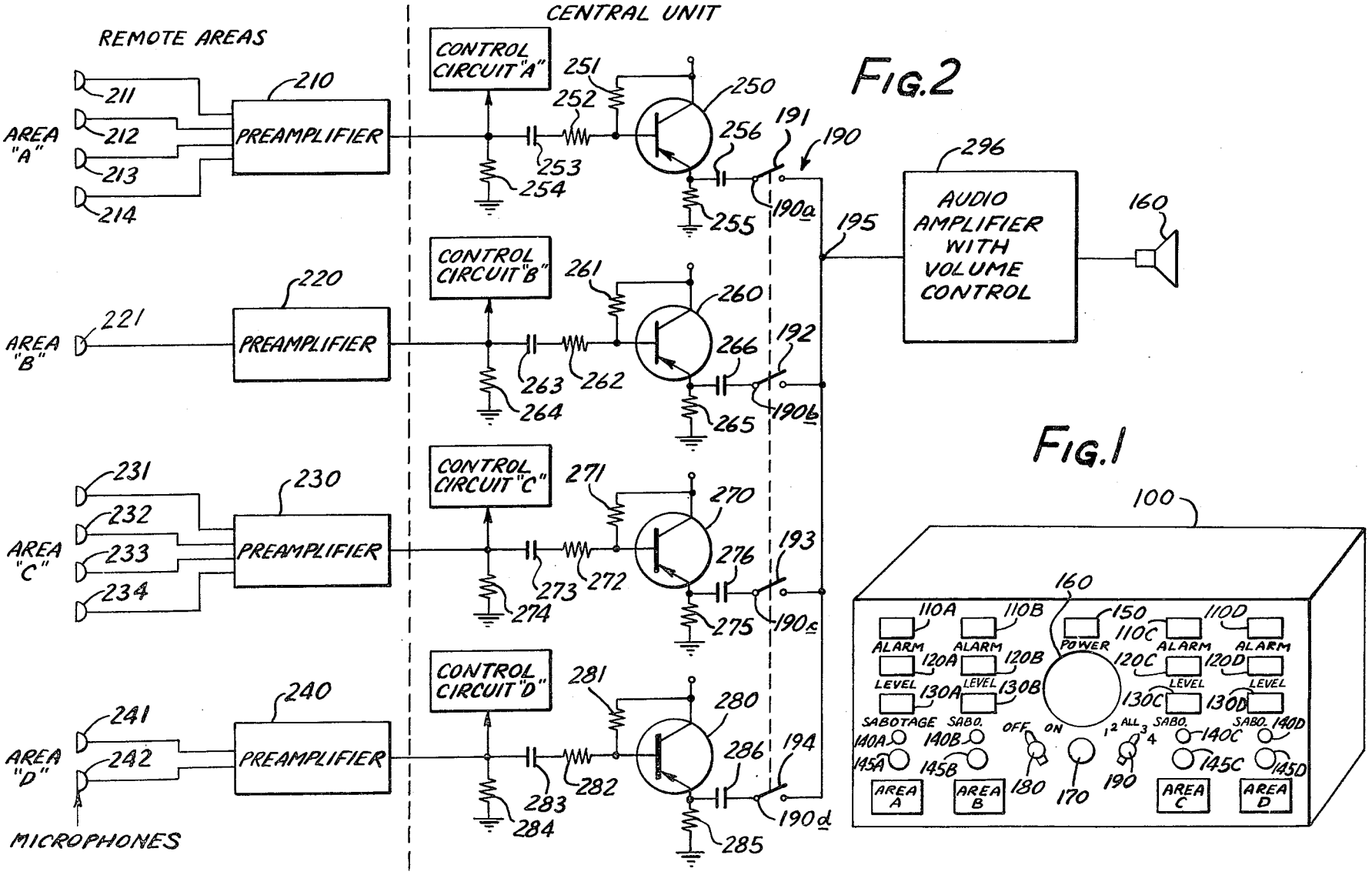
FIG. 1 is a perspective view of a central monitor and intruder alarm unit for a system constructed in accordance with the principles of the invention.
FIG. 2 is an electrical schematic wiring diagram of a circuit in accordance with a preferred embodiment of the invention which may be advantageously used with the central unit illustrated in FIG. 1.

As shown in the drawings for purposes of illustration, the invention is embodied in a system for simultaneously monitoring and indicating an unauthorized intrusion into any one of a plurality of remote areas "A", "B", "C", and "D" at a centrally-located monitor and alarm unit 100 which may be conveniently observed by security personnel (not shown). Whenever a sound in any one or more of the remote areas exceeds a predetermined threshold level, indicating an unauthorized intrusion therein, acousto-electric transducers in the form of microphones convert the sound into electrical signals which are transmitted to the unit 100 to actuate corresponding alarm indicating means in the form of "alarm" lamps 110A, 110B, 110C, and 110D and sirens 145A, 145B, 145C, and 145D, which operate to signal those areas at which the sound occurred. In addition, security personnel may actually listen to the remote area in which the threshold sound occurred by operation of a switch means 190 which couples the acousto-electric transducers in that area to an acousto-electric output means in the form of a loudspeaker 160 which reproduces the sound.

In accordance with the present invention, not only does the system alert security personnel to unauthorized intrusions when the sound in a given remote area exceeds a predetermined threshold level, it also provides an indication of the actual sound level in each remote area regardless of whether or not it exceeds the threshold level. Accordingly, visual sound level indicating means are provided in the form of "level" lamps 120A, 120B, 120C, and 120D, each of which glows in intensity in accordance with the sound level of its respective area. Whenever the security guard operating the system of the invention observes that one of the level lamps has a brighter glow than that of the others, or than that which is customary for that particular area, he may switch to that area to listen more closely to the sounds therein to determine what is the cause of the increased level of sound. Alternatively, in accordance with another aspect of the invention, the security guard may listen to all of the remote area sounds simultaneously so that he may hear initially any suspicious noises in any one or more of the remote areas. Once he hears a suspicious noise and/or notes an increased glow from a level lamp for a given area, he may simply operate switch means 190 to select that area and the volume of output from the transducer 160 is automatically increased to enable him to more closely ascertain what is generating the suspicious noise.

In accordance with the illustrated embodiment of the invention, a simple manual control means in the form of threshold or "background level" controls 140A, 140B, 140C and 140D on monitor unit 100 may be readily adjusted to control the threshold level for the alarm lamps 120A-120D as well as suitable audio alarm means such as sirens 145A-145D. This permits the system to be adjusted to adapt to temporary situations such as when cleaning personnel are working in a remote area or traffic noise is high in a given area. In such a situation, the threshold level control for that area may be adjusted to provide a higher threshold, so that alarm lamps are not triggered by the temporary condition, and then readjusted to the normal level when the temporary condition terminates. In certain applications of the invention, the threshold and level controls may be combined in a single control to further simplify operation of the system and, for example automatically adjust the level control such that the associated level lamp glows at maximum brightness when the sound in that area attains the threshold level. With such flexibility and simple controls, most security personnel can readily operate the system of the invention to accommodate the many and varied situations that may arise.

As explained in detail hereinafter, monitor and alarm control unit 100 is a rather compact unit which is constructed from a number of relatively simple electronic circuits and uses small electrical cables readily strung to the acousto-electric transducers in the remote areas. Should the cables be cut or the apparatus in the remote areas be tampered with, sabotage indication means in the form of "sabotage" lamps 130A, 130B, 130C, and 130D are operated to indicate in which remote area the sabotage occured. The system of the illustrated embodiment of the invention may not be reset until both the sound falls below the threshold level for that area and a sabotage condition does not exist, thus preventing the disarming of the system during an unauthorized intrusion. The illustrated system may also be readily tested by the operator to make sure that the system is operating properly.

With reference to FIG. 2, there is shown an electrical schematic diagram of a circuit constructed in accordance with the illustrated embodiment of the invention which may be advantageously employed in central unit 100 of FIG. 1. In general, a plurality of acousto-electric transducers, illustrated here as microphones, are positioned in the remote areas to be monitored for converting acoustical signals therein to electrical signals having an amplitude representative of the intensity of the acoustical signals. A plurality of preamplifiers are each positioned in one of the remote areas for amplifying the electrical signals from the microphones. As illustrated, area "A" has a preamplifier 210 positioned therein with four microphones 211, 212, 213, 214 also positioned therein at suitable locations for receiving essentially all of the acoustical signals therein. Area "B" has a preamplifier 220 and a single microphone 221; Area "C", a preamplifier 230 and four microphones 231, 232, 233, and 234; Area "D", a preamplifier 240 and two microphones 241 and 242. The preamplifiers and microphones may be of any desired conventional type suitable for this purpose. The number of microphones employed for a given area is a matter of design choice, depending on the size and type of the particular area being monitored. Area "A", for example, may comprise a relatively large entrance having several doors and adjacent windows whereas Area "B" may be a relatively small, single-door entrance which thus requires only a single microphone for receiving the acoustical signals therein.

The electrical output signals from the four preamplifiers 210, 220, 230, and 240 are respectively coupled to control circuits A, B, C, and D and to an audio amplifier 296 and an electro-acoustic transducer in the form of a loudspeaker 160 by isolating transistors 250, 260, 270, and 280 and a switching means illustrated here as a multi-position switch 190. The control circuits comprise the means for actuating the "alarm", "level", and "sabotage" lamps and are discussed more particularly below with reference to FIG. 3. Switch 190 has a single output terminal 195 and a plurality of input terminals 190*a*, 190*b*, 190*c*, and 190*d* for respectively receiving the amplified electrical signals and selectively coupling any one of the amplified electrical signals to output terminal 295 by mechanical means, such as a five-position rotary wafer switch (not shown in FIG. 2). Switch 190 is also operable to selectively couple all of the amplfied electrical signals to output terminal 195 so that all of the remote areas may be monitored simultaneously. Audio amplifier 296 and loudspeaker 160 are essentially conventional and provide means for the further amplification of the electrical signal and the conversion of it to an acoustical signal suitable for operator listening.

More particularly, the biasing circuitry for each isolation transistor 250, 260, 270, and 280 shown in FIG. 2 is essentially conventional; the respective emitter resistors 255, 265, 275, and 285, however, are selected such that the impedance presented to the input circuit of audio amplifier 296, in accordance with an optional aspect of the illustrated embodiment of the invention, is greater when an individual remote area is selected for operator listening by switch 190 than when all remote areas are selected for operator listening. A better power transfer is thus obtained when switch 190 is switched from the "all" position to any one of the four individual positions ("A", "B", "C", or "D") to provide an automatic increase in the amplitude in the audio output of loudspeaker 160 for listening to an individual area.

Figure 3:
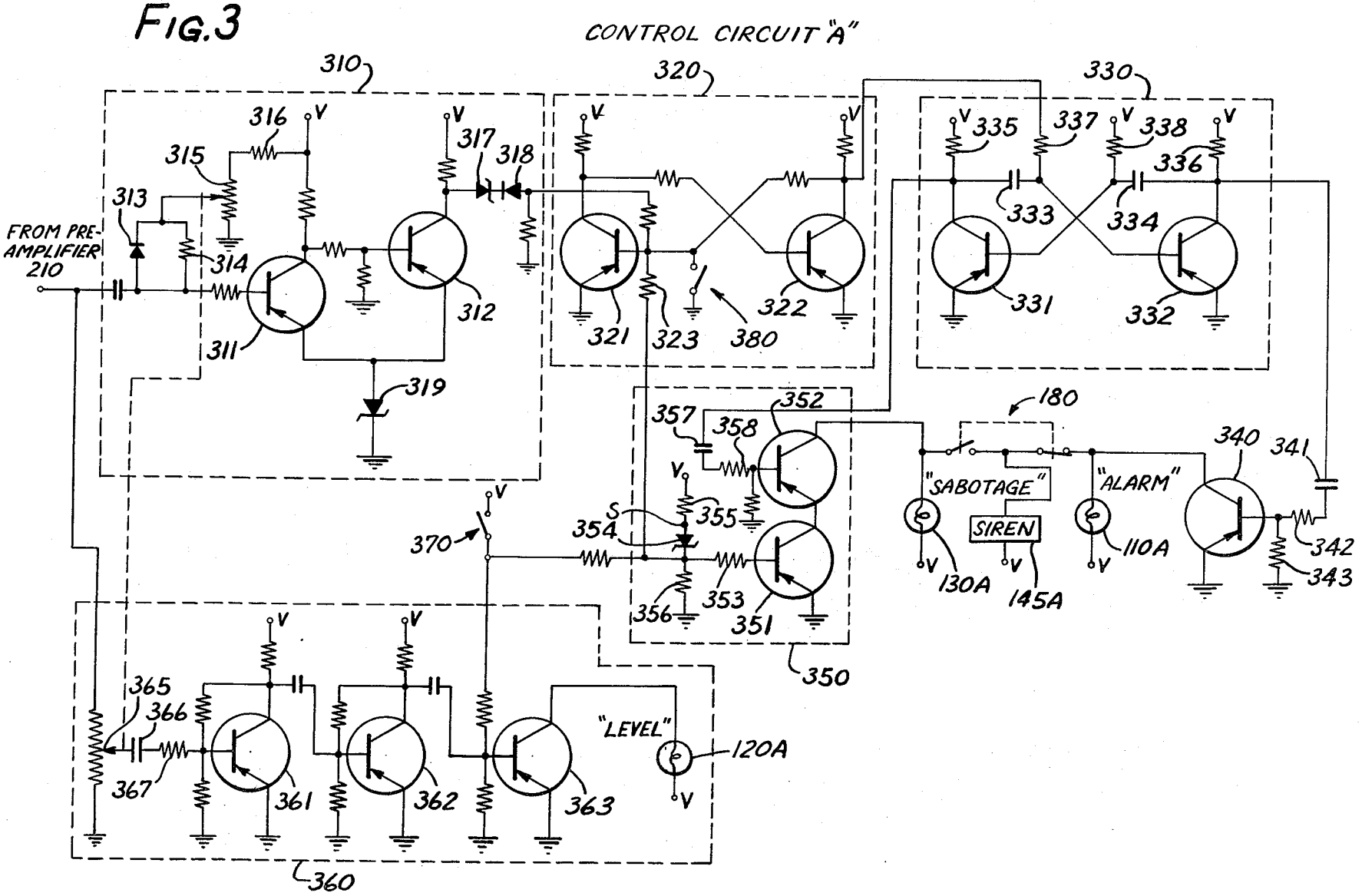
FIG. 3 is an electrical schematic wiring diagram illustrating a portion of the circuit of FIG. 2 in greater detail.

With reference to FIG. 3, there is shown an electrical schematic diagram of control circuit "A" of FIG. 2. Control circuits "B", "C", and "D" are essentially identical to control circuit "A" and, for the purposes of simplifying the drawings, are not shown. In general, control circuit "A" comprises an adjustable amplitude detector circuit 310 which is responsive to the amplitude of the corresponding amplified electrical signal exceeding a predetermined threshold level indicative of an unauthorized intrusion in that area for developing an alarm signal. Detector circuit 310 is made adjustable so that the threshold level of the electrical signal for which it is desired to sound the alarm may be set at a level suitable for the typical sound level in that area. The alarm signal output of detector 310 is coupled to an indicating means, comprising an oscillator circuit 330, a switching transistor 340, and an "alarm" lamp 110A, by an actuating means illustrated as a "flip-flop" circuit 320. A switching signal developed by "flip-flop" circuit 320 in response to the alarm signal actuates an oscillator circuit 330 to thus generate an oscillatory output signal having a repetition rate of approximately five Hertz. The oscillatory signal is applied to switching transistor 340 which alternately connects and disconnects an "alarm" circuit to ground. The alarm circuit includes "alarm" lamp 110A, a siren 145A, a suitable source voltage V, and switching transistor 340. An adjustable amplitude or "level" indicator circuit 360 is responsive to the amplified electrical signal from preamplifier 210 for developing a visual indicator signal that systematically varies in accordance with the amplitude of the electrical signal. In the illustrated embodiment of the invention, the visual indication is provided by an incandescent "level" lamp 120A. As explained below in greater detail, circuit 360 is made adjustable so that the operator may set the input signal at a level which is suitable for the background noise of the remote area being monitored.

In accordance with another aspect of the invention, a gating means shown here in the form of an AND gate 350 is provided for developing a control signal to indicate unauthorized tampering with any of the remote-area equipment. By utilizing an AND gate for the gating means, it is possible to have the "sabotage" lamp flash by taking advantage of the signal generated by oscillator 330, as described below in greater detail.

Referring now in greater detail to detector circuit 310 of FIG. 3, it comprises a pair of switching transistors 311 and 312 and an adjustable clamp circuit including diode 313, resistor 314, and potentiometer 315, and a series limiting resistor 316 coupled to a suitable supply voltage V (e.g., -18 volts). Potentiometer 315 is adjusted to apply a DC bias or threshold voltage (about which the input signal is referenced) to the base of transistor 311 so that it is rendered nonconductive or turned "off" in the quiescent state. Diode 313 minimizes distortion of the re-referenced input signal. Zener diode 319 provides a relatively fixed emitter or reference voltage for switching transistors 311 and 312 on and off. When the value of the input electrical signal exceeds the predetermined threshold value, which value corresponds to an unauthorized intrusion in the area being monitored, transistor 311 is turned on which turns off transistor 312 to thus develop an alarm signal in the form of a voltage (approximately equal to supply voltage V) at the collector of transistor 312. Thus, only those electrical signals having an amplitude corresponding to an acoustical signal having an intensity greater than a predetermined threshold or "background noise" level actuate detector circuit 310 to develop the alarm signal. Zener diode 317 and a conventional diode 318 apply the alarm signal to switching circuit 320. Diode 318 protects transistor 321 of "flip-flop" circuit 320 from positive voltage transients which occur during the switching of transistor 312 due to the capacitance inherent in Zener diode 317.

Actuating means in the form of flip-flop circuit 320 comprises switching transistors 321 and 322 and the associated biasing resistors employed in an essentially conventional "flip-flop" configuration. The alarm signal from detector 310 is applied to the base of transistor 321 to turn it on which turns off transistor 322, in the conventional flip-flop manner. The collector voltage of transistor 322, when the transistor is in the nonconductive or "off" state, is essentially the same as the source voltage V and this collector voltage is applied to the base of transistor 332 of oscillator circuit 330.

Oscillator circuit 330 is an essentially conventional free-running multivibrator comprising a pair of transistors 331 and 332 and the associated biasing circuitry. The values of timing capacitors 333 and 334 as well as resistors 337 and 338 are selected to cause oscillator circuit 330, when activated by switching circuit 320, to have a repetition rate of approximately 5 Hertz. The output signal for oscillator circuit 330 is taken at the collector of transistor 332 and is applied to the base of switching transistor 340 by the means of a differentiating capacitor 341 and coupling resistor 342. Resistor 343 biases transistor 340 such that the negative pulses or "spikes" developed by capacitor 341 cause switching transistor 340 to "close" to thereby complete the circuit from supply voltage V through "alarm" lamp 110A to cause it to flash at the rate of approximately five flashes per second.

Gating circuit 350 comprises a pair of switching transistors 351 and 352 operated as an AND gate, and a voltage reference network comprising a Zener diode 354 and a series resistors 355 and 356. The base of switching transistor 351 is coupled to the junction of Zener diode 354 and series resistor 356 by means of a base input resistor 353. The base of switching transistor 351 is also coupled to the base of switching transistor 321 of flip-flop circuit 320 by means of base input resistor 353 and coupling resistor 323. Thus, switching transistor 351 is responsive to the bias voltage established by the voltage reference network, which in turn is responsive to both the supply voltage V and the voltage applied to the junction of Zener diode 354 and resistor 355 (by means of terminal S), to close "one-half" of the AND gate. The voltage established at terminal S is determined by preamplifier 210 of FIG. 2 to indicate the operating condition of the remote area equipment, and it may be coupled by the same wires or cable carrying the autio signal. As long as the remote equipment of this system is operating without interference (e.g., the microphones are connected to the preamplifier, the preamplifier is connected to its power source, etc.), the voltage applied to terminal S by preamplifier 210 is insufficient to overcome the reverse-bias voltage drop across Zener diode 354 and turn on switching transistor 351. Whenever the operation of the remote equipment is interfered with by an unauthorized intruder, a janitor, or whatever (e.g., a microphone is disconnected from the preamplifier, the preamplifier is disconnected from the power source, etc.), the voltage applied to terminal S by preamplifier 210 is sufficient to offset the Zener voltage and turn on transistor 351. One specific way to accomplish this is to include a circuit element in preamplifier 210 of FIG. 2 such as a Zener diode 210Z, so that as long as there is no interference with the remote equipment, Zener diode 210Z maintains Zener diode 354 reverse biased but, upon any interference with the operation of the remote equipment, Zener diode 210Z is effectively disconnected from terminal S to thereby turn on switching transistor 351. The voltage at the base of transistor 351 is also coupled to the base of switching transistor 321 to turn it on and thus activate oscillator 330. Of course, the "sabotage" voltage circuit may further include appropriate wiring and miniature switches operatively associated with the cabinets containing the remote equipment so that whenever they are entered the circuit is broken and transistor 351 and 321 are turned on.

Switching transistor 352, the other "half" of the AND gate, has its base coupled to the collector of transistor 331 of oscillator 330 by means of a differentiating capacitor 337 and coupling resistor 358 so that transistor 352 is turned on in accordance with the repetition rate of oscillator 330. The collector of switching transistor 351 is coupled to the emitter of switching transistor 352 to form a series switching circuit or "AND gate". Only when both switching transistor 351 and 352 are turned on is the circuit completed; that is, "sabotage" lamp 130A is coupled from supply voltage V to ground and is thereby illuminated. Thus, when detector circuit 310 detects an unusual noise in the remote area (i.e., one louder than the preset "background" level), the "alarm" lamp flashes; when the remote area equipment is tampered with, however, both the "alarm" and "sabotage" lamps flash (alternately because of being connected to "opposite" multivibrator transistors in oscillator 330). In addition, a switch 180 is provided as shown in FIG. 3 to enable sirens 145A-145D to be actuated simultaneously with "alarm" lamps 110A-110D. Switch 180 enables the operator of the system to disconnect the sirens from the "alarm" lamps so that, for example, the operator may turn off the sirens to listen more closely to the situation which triggered the alarm. Switch 180 is constructed, however, such that when it disconnects the sirens from the "alarm" lamps it connects the sirens to the "sabotage" lamps so that, when a sabotage condition occurs, the siren is actuated regardless of the position of switch 180.

Amplitude-indicating circuit 360 comprises three amplifying transistors 361, 362, and 363 which drive a "level" lamp 120A coupled between the collector of transistor 363 and a suitable supply voltage V for developing a visual signal that systematically varies in accordance with the amplitude of the monitored acoustical signal. By means of a coupling capacitor 366, a coupling resistor 367, and a potentiometer 365, the output signal from preamplifier 210 is coupled to the base of transistor 361. Potentiometer 365 provides a means for adjusting the amplitude of the input signal to suit the typical level of background noise in the remote area being monitored.

Testing the system to check the operation of the "alarm", "sabotage", and "level" lamps, as well as the sirens, may be performed very simply by the contact closure of a "test" switch 370 (which may, for convenience, be incorporated with the corresponding "alarm" lamp on the front panel of device 100). Closing test switch 370 applies a suitable voltage V to switching transistor 321, 351, and 363 to activate the associated siren and lamps.

Resetting the system may be accomplished rather easily by the contact closure of "reset" switch 380. Grounding the base of switching transistor 321 resets or "toggles" flip-flop circuit 320 to the initial or "ready" state unless a sabotage condition exists which prevents resetting.

Thus, the invention provides an improved system for simultaneously and centrally monitoring a plurality of remote areas and selectively indicating an unauthorized intrusion into any of the areas. The system of the invention also selectively indicates when any remote area equipment is tampered with. The control panel provides relatively quick and simple indicator signals so that a single operator may readily recognize which area has been entered by an unauthorized intruder. In addition, the system of the invention is readily adaptable to monitor practically any number of remote areas as well as being adaptable to areas having different sizes and configurations.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A system for simultaneously monitoring a plurality of predetermined remote areas and selectively indicating an unauthorized intrusion into any of said areas, comprising:

a plurality of acousto-electric transducers positioned in said remote areas for converting an acoustical signal therein to an electrical signal having an amplitude representative of the intensity of said acoustical signal;

a plurality of amplifiers each positioned in one of said remote areas and coupled to the transducers in that area for amplifying said electrical signals;

a plurality of lamp means responsive to said amplified electrical signals for developing a visual indicator signal for each of said remote areas that systematically varies in accordance with the amplitude of said electrical signal from its associated area;

a plurality of detecting means each coupled to one of said amplifiers and responsive to the amplitude of the corresponding amplified electrical signal exceeding a predetermined threshold level indicative of an unauthorized intrusion in that area for developing an alarm signal;

a plurality of alarm indicating means each coupled to one of said detecting means and responsive to the corresponding alarm signal for indicating said unauthorized intrusion;

switching means having a corresponding plurality of input terminals respectively coupled to said amplified electrical signals and an output terminal for selectively coupling any one of said electrical signals to said output terminal, said switching means also operable to selectively couple all of said electrical signals to said output terminal;

and means including an electro-acoustic transducer coupled to said output terminal for converting said selected amplified electrical signal into an acoustical signal.

2. A system according to claim 1, in which each said alarm indicating means further includes the series combination of an actuating means, an oscillator circuit having a predetermined repetition rate, and a visual alarm indicator, said actuating means comprising means for latching said oscillator circuit to continuously operate, and manually operated switch means to reset said oscillator means and to unlatch the same.

3. A system for simultaneously monitoring a plurality of predetermined remote areas and selectively indicating an unauthorized intrusion into any of said areas, comprising:

a plurality of acousto-electric transducers positioned in said remote areas for converting an acoustical signal therein to an electrical signal having an amplitude representative of the intensity of said acoustical signal;

a plurality of amplifying means, one of said amplifying means being positioned in each one of said remote areas and coupled to the transducers in that area for amplifying said electrical signals;

a plurality of detecting means, one of said detecting means being coupled to each one of said amplifying means and responsive to an amplified electrical signal exceeding a predetermined threshold level indicative of an unauthorized intrusion in that area for developing an alarm signal;

a plurality of alarm indicating means each coupled to one of said detecting means and responsive to the corresponding alarm signal for indicating said unauthorized intrusion;

switching means coupled to said amplifying means and having a corresponding plurality of input terminals for receiving said amplified electrical signals and an output terminal for selectively coupling any one of said amplified electrical signals to said output terminal, said switching means also operable to selectively couple all of said electrical signals to said output terminal, said switching means further including volume control means for automatically increasing the volume of said acoustical signal when only the area is being monitored; and output means including an electro-acoustic transducer coupled to said output terminal for converting said selected amplified electrical signal into an acoustical signal.

4. A system according to claim 3, in which said volume control means comprises a corresponding plurality of coupling transistors coupled between said amplifying means of said switching means, said coupling transistors each having an emitter impedance connected thereto having a value such that a better power transfer is effected between said coupling transistors and said output means when one amplified electrical signal is selected by said switching means than when all said signals are selected by said switching means, thereby automatically increasing the volume of said acoustic signal when only one area is being monitored.

5. A system according to claim 2 which further comprises means for resetting said alarm indicating means only when an alarm situation no longer exists.

6. A system according to claim 2 which further comprises means for testing the operation of said alarm indicating means.

7. A system according to claim 2 in which said alarm indicating means comprises both audio and visual indicators.

8. A system according to claim 3 in which said alarm indicating means comprises both audio and visual indicators.

* * * * *